US008281616B2

(12) United States Patent
Bergundthal et al.

(10) Patent No.: US 8,281,616 B2
(45) Date of Patent: Oct. 9, 2012

(54) BRACELET WITH ARTICULATED LINKS

(75) Inventors: Kurt Bergundthal, Oberdorf (CH); Vincent Brunner, Les Reussilles (CH)

(73) Assignee: Montres Rado S.A., Lengnau (CH)

( * ) Notice: Subject to any disclaimer, the term of this patent is extended or adjusted under 35 U.S.C. 154(b) by 0 days.

(21) Appl. No.: 13/152,383

(22) Filed: Jun. 3, 2011

(65) Prior Publication Data

US 2011/0259049 A1 Oct. 27, 2011

Related U.S. Application Data

(63) Continuation of application No. 13/091,631, filed on Apr. 21, 2011, now abandoned.

(30) Foreign Application Priority Data

Apr. 23, 2010 (EP) ..... 10160843

(51) Int. Cl.
*A44C 5/10* (2006.01)

(52) U.S. Cl. ..... 63/4; 63/9; 63/38; 224/164; 368/282

(58) Field of Classification Search ..... None
See application file for complete search history.

(56) References Cited

U.S. PATENT DOCUMENTS

| | | | |
|---|---|---|---|
| 5,951,193 | A | 9/1999 | Yamamoto et al. |
| 6,418,706 | B1 | 7/2002 | Kit |
| 2002/0012569 | A1 | 1/2002 | Horiguchi |
| 2006/0272354 | A1 | 12/2006 | Hostettler et al. |

FOREIGN PATENT DOCUMENTS

| | | |
|---|---|---|
| EP | 1 175 843 A2 | 1/2002 |
| EP | 1 731 053 A1 | 12/2006 |
| GB | 2 297 999 A | 8/1996 |

OTHER PUBLICATIONS

European Search Report issued Nov. 1, 2010, in European Patent Application No. 10160843.8, filed Apr. 23, 2010.

*Primary Examiner* — Jack W. Lavinder
(74) *Attorney, Agent, or Firm* — Oblon, Spivak, McClelland, Maier & Neustadt, L.L.P.

(57) ABSTRACT

A bracelet with links articulated to each other like a hinge, includes first links provided with a male hinge part pierced by a first through hole, second links provided with a female hinge part pierced by second and third through hole, the first, second and third holes forming an alignment when a male hinge part is engaged in a female hinge part. The bracelet further includes pins occupying the hole alignments, and axial locking elements for the pins formed of a first radially elastic tube and a second tube, axially locked in the first through holes, the pins being driven inside the first slit tubes. The first and second tubes include an annular end via which the tubes are secured to each other so as to preserve the radial elasticity of the first tube.

29 Claims, 5 Drawing Sheets

BRACELET WITH ARTICULATED LINKS

CROSS REFERENCE TO RELATED APPLICATIONS

This application is a continuation of U.S. application Ser. No. 13/091,631 filed Apr. 21, 2011, and is based upon and claims the benefit of priority from European Patent Application No. 10160843.8 filed Apr. 23, 2010, the entire contents of each of which are hereby incorporated herein by reference.

FIELD OF THE INVENTION

The present invention relates to the field of watchmaking and jewelry. It concerns more specifically a bracelet with links hinged to each other by a pin.

BACKGROUND OF THE INVENTION

Discussion of Background

Bracelets of this type are well known to those skilled in the art. They comprise a plurality of identical or matched links, articulated in pairs like a hinge including a male part, a female part and a connecting pin. The links are, for example, I-shaped elements alternating with H-shaped elements between the branches of which they are engaged. They may also be elements of more complex shape, including the male hinge part on one side and the female part on the other. There are holes through the links which are aligned when the male part is engaged in the female part, and in which the pins are placed.

Assembling the links using pins responds to specific requirements linked to the use of the bracelet. It will be noted first of all that the pins must be locked axially inside the aligned holes, so as not to come out of said holes, but they must be free to rotate inside one of the male or female hinge parts, to avoid interfering with the movement of articulation of the links. Moreover, they must be removably mounted so that a link can be removed or added if the length of the bracelet is adjusted.

When the links are made of metal, one solution to the various assembly constraints of the pins consists in driving the pins inside the male hinge part and leaving them free in the female part. This solution cannot be adopted for ceramic links because of the fragile nature of the material. Indeed, as ceramic material is not capable of plastic deformation, the links would be liable to break when the pins were driven in. Moreover, the diameter of the through holes must be given with great accuracy for it to be possible to drive a pin therein. However, it is difficult and expensive to pierce holes in ceramic with low tolerance.

Thus, in the state of the art, intermediate parts are used for assembling the pins with ceramic links. These parts are formed of a first tube, provided with a longitudinal slit, which is formed of an elastically deformable material, such as metal or plastic, and a second tube with no slit. The relative radial and longitudinal dimensions of the various hinge elements are important for the operation of the articulation. The male hinge part of the links is pierced with a through hole of larger diameter than that of the holes in the female hinge part. The diameter of the pin is smaller than the diameter of the holes made in the male and female hinge parts. The external diameter of the first and second tubes is larger than the diameter of the holes in the female hinge part, but smaller than the diameter of the hole in the male part. The inner diameter of the first slit tube is slightly smaller than the diameter of the pin, while the inner diameter of the second tube is slightly larger. The latter is also smaller than the external diameter of the first slit tube. Finally, the total length of the first and second tubes placed end-to-end is substantially equal to the length of the hole in the male hinge part, and the length of the pin is substantially equal to the sum of the lengths of the hole in the male hinge part and two holes in the female hinge part.

The first and second tubes are placed end-to-end inside the male hinge part of a first link. As their external diameters are greater than the diameter of the holes in the female hinge part, said tubes are axially locked in the male hinge hole. Moreover, they cannot slide into each other, because of their relative internal and external diameters. The pin is housed inside the first and second tubes, the ends thereof being engaged in holes in the female hinge part of a link next to the first link, in which they can rotate freely. As the internal diameter of the second tube is greater than the diameter of the pin, the latter is free inside the second tube. Conversely, as the internal diameter of the first slit tube is slightly smaller than the diameter of the pin, the latter is axially and rotatably secured to the first tube, under the gripping action that the tube exerts on the pin. It will be noted that the pin is driven into the first slit tube. Since said tube has a slit, it extends slightly radially under the driving in action, such that its initial diameter does not necessarily have to be given with great accuracy relative to the diameter of the pin.

As the pin is integral with the first slit tube, it is trapped inside the hole passing through the male hinge part. Moreover, it is axially locked inside said hole by the second tube which occupies the other portion of the length of the hole and therefore blocks any axial movement of the first slit tube.

Thus positioned in the aligned holes in two neighbouring links, the pin ensures the holding and articulation of said links. Moreover, it can easily be removed from the links, to dismantle the bracelet, by being driven out of the first slit tube. For this purpose, a rigid rod is used, whose diameter is slightly smaller diameter than that of the pin, to drive the pin out of the slit tube when said rod is actuated by a hammer.

This articulated bracelet is assembled manually and essentially includes the following steps:

- Introducing the first and second slit tubes into the through hole in the male hinge part of a first link.
- Engaging the male hinge part of said first link in the female hinge part of a second link so as to align the through holes.
- Positioning a pin through the through holes by driving said pin inside the first slit tube after engagement in the second tube.

In addition to the aforementioned steps, adjustment of the length of this bracelet includes a first step of driving a pin out of the first slit tube so as to separate two neighbouring links.

The assembly steps thus described must be carried out with great care. It is important, for example, to place both types of tubes in the through hole of the male hinge part without confusing them up or inverting them. Confusion between a slit tube and a non-slit tube could, in the worst case scenario, result in the bracelet opening inadvertently and the watch being lost. It is also recommended to insert the pin into the through holes, by starting with the second non-slit tube, to avoid driving in virtually the entire length of the pin through the first slit tube. Because of the small size and similarity of the parts, the risk of assembly error is significant and potentially very inconvenient. It will also be noted that it takes a considerable amount of time to assemble a bracelet of this type, which has a non-negligible impact on the final cost thereof.

SUMMARY OF THE INVENTION

The present invention at least partially overcomes these various drawbacks, by proposing a bracelet with articulated links which is easier and quicker to assemble due to the reduced number of parts. More specifically, the present invention concerns a bracelet with links articulated like a hinge, including:

- first links provided with a male hinge part pierced with a first through hole,
- second links provided with a female hinge part pierced with second and third through holes, said first, second and third holes being aligned when a male hinge part is engaged in a female hinge part,
- pins occupying said aligned holes, and
- elements for axially locking said pins, formed of a first radially elastic tube and a second tube, axially locked in said first through holes, said pins being driven inside said first slit tubes, characterized in that said first and second tubes includes an annular end via which they are secured so as to preserve the radial elasticity of said first tube.

Owing to this feature, it is only necessary to place one part, and not two parts, inside the through holes in the male hinge part, which simplifies and streamlines assembly of the bracelet.

BRIEF DESCRIPTION OF THE DRAWINGS

In an advantageous embodiment, the first tube is provided with a longitudinal slit and said first and second tubes are integral over an angular portion of less than 180°, extending substantially opposite said longitudinal slit. Other features and advantages of the present invention will appear more clearly from the following detailed description of an example embodiment of a bracelet with articulated links according to the invention, this example being given purely by way of non-limiting illustration, with reference to the annexed drawings, in which.

DETAILED DESCRIPTION OF THE PREFERRED EMBODIMENTS

Figure 1:
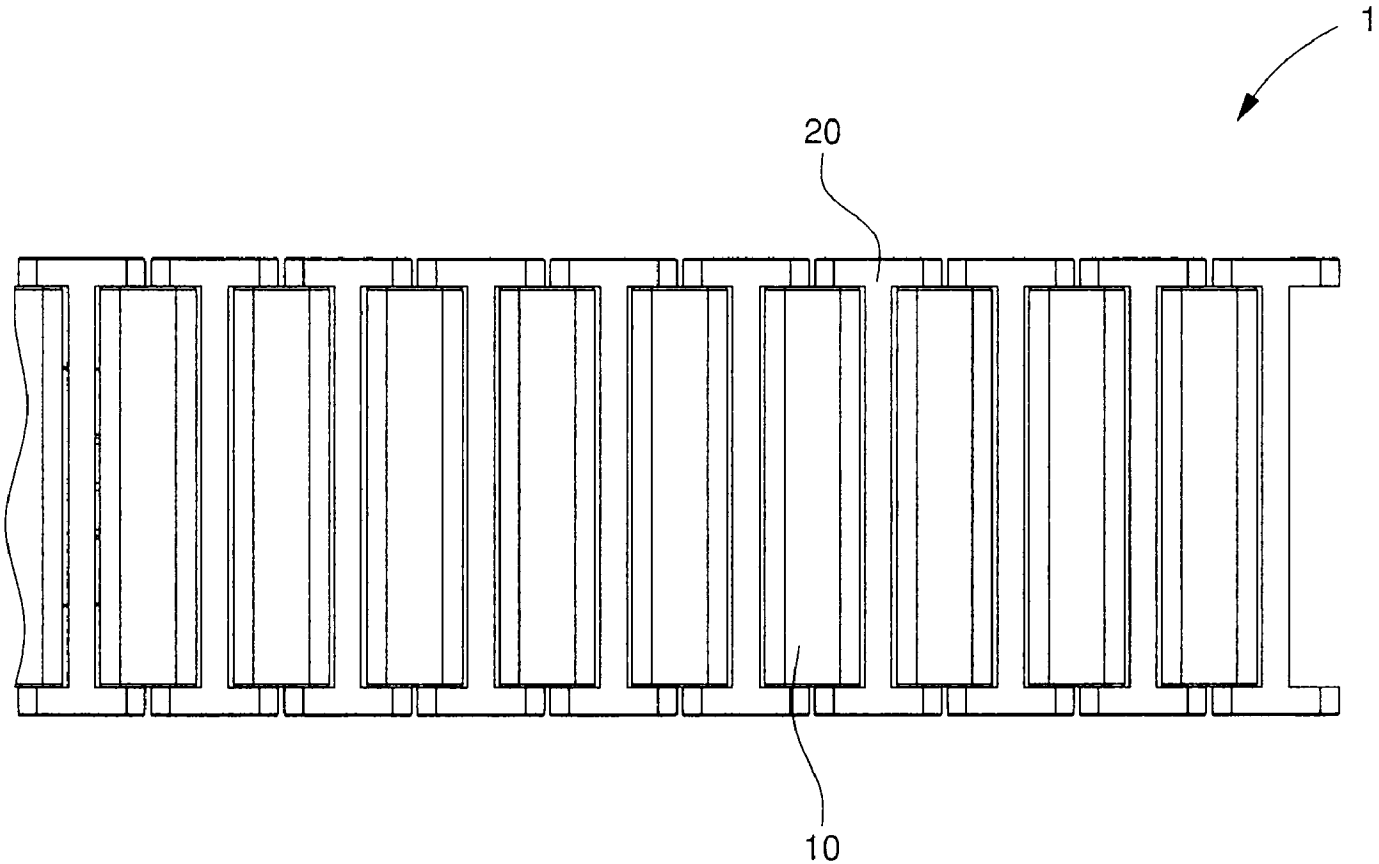
FIG. 1 shows a top view of a bracelet with articulated links according to the invention.

The bracelet with articulated links shown in FIG. 1, and referenced generally 1, includes first, substantially I-shaped links 10, alternating with second, substantially H-shaped links 20, wherein one I-shaped link 10 forms, with one H-shaped link 20 one step in the longitudinal development of the bracelet. Thus, each first I-shaped link 10 is partially engaged between the branches of a second H-shaped link 20 arranged to the right thereof, and partially between the branches of a second H-shaped link 20 arranged to the left thereof, and so on until the ends of the bracelet.

Figure 2:
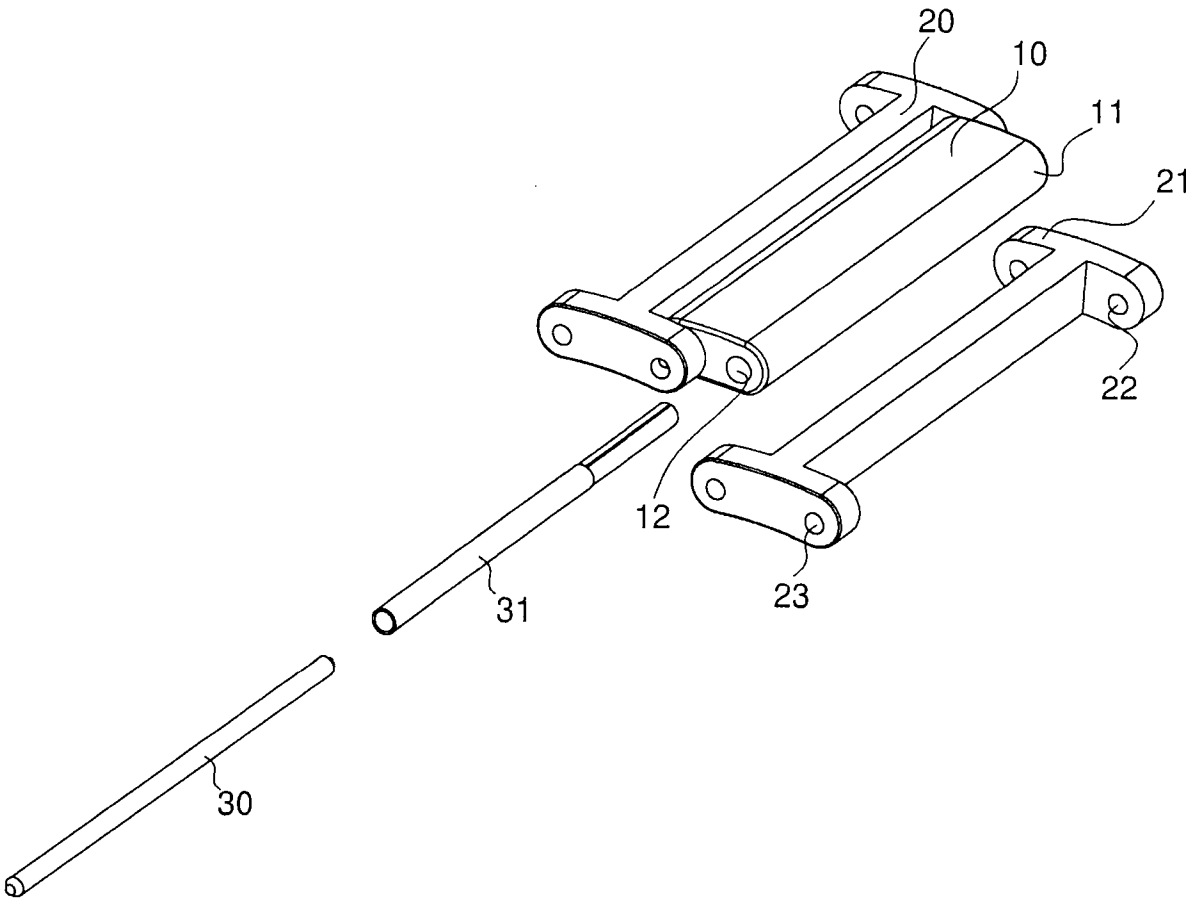
FIG. 2 is an exploded view of three consecutive links of this bracelet.
Figure 3:
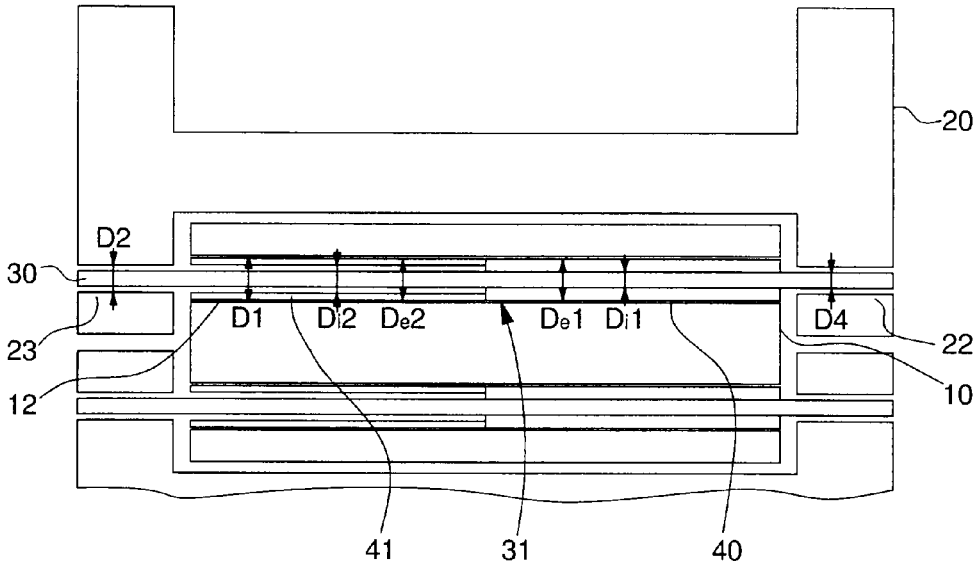
FIG. 3 is a cross-section in the plane of the links of the bracelet according to the invention.

As shown in FIGS. 2 and 3, the first and second links 10, 20 are articulated in pairs like a hinge, wherein the male part 11 is formed by one longitudinal half of a first I-shaped link 10 and the female part 20 is formed by the branches of a second H-shaped link 20. The male hinge parts 11 of links 10 are pierced longitudinally with a first through hole 12, while the female hinge parts 21 of the second links 20 are pierced with second and third through holes 22, 23 parallel to the median branch of the H. For reasons that will become clear below, the second and third through holes 22, 23 have a smaller diameter D2 than the diameter D1 of the first through holes 12. Holes 12, 22, 23 are also arranged to form an alignment when the male hinge part 11 is engaged in the female hinge part 21. A pin 30 is placed inside said hole alignment, so as to ensure the holding and articulation of two neighbouring links 10, 20. An axial locking element 31 for pin 30 is axially locked inside the first through hole 12 in male hinge part 11.

Figure 4:
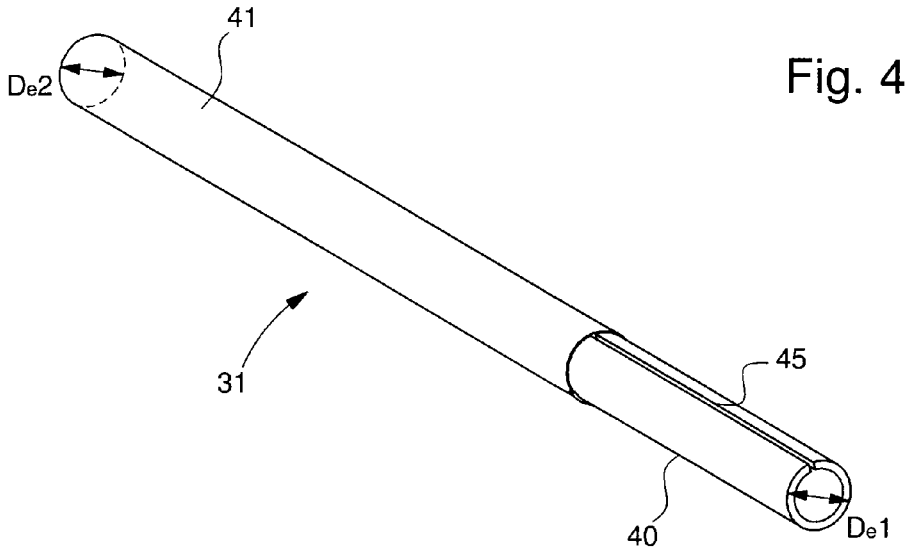
FIGS. 4 and 5 show respectively perspective and transverse cross-sectional views of one element of the bracelet according to the invention.

Axial locking element 31 of pin 30, shown in perspective in FIG. 4, is formed of a first tube 40 provided with a longitudinal slit 45 and a second tube 41 which has no slit. The first tube 40 is formed of an elastically deformable material such as metal or plastic. The presence of longitudinal slit 45 gives said tube radial elasticity, the function of which will become apparent below. The external diameters of said tubes 40 and 41, respectively De1, De2, are greater than the diameter D2 of the second and third through holes 22, 23, and smaller than the diameter D1 of the first through holes 12. Because of this feature, tubes 40 and 41 are axially locked inside a first through hole 12 when the latter forms an alignment with a second and third through hole 22, 23. The combined length of a first and second tube 40, 41 is substantially equal to the length of the first through hole 12, such that said tubes 40, 41 cannot slide inside a through hole 12.

As illustrated in FIG. 3, the external diameter D4 of a pin 30 is smaller than the internal diameter Di2 of a second, non-slit tube 41, in which it is freely engaged. However, the same external diameter D4 is slightly larger than the internal diameter Di1 of a first slit tube 40. Because of the radial elastic property of first tube 40, conferred by longitudinal slit 45, said first tube 40 exerts a gripping action on pin 30, which is thereby secured to said tube in rotation and translation. As pin 30 is kept secured to a first slit tube 40 and the latter is axially locked in first through hole 12, the pin is itself axially locked in the alignment formed by the first, second and third through holes 12, 22, 23.

Figure 5:
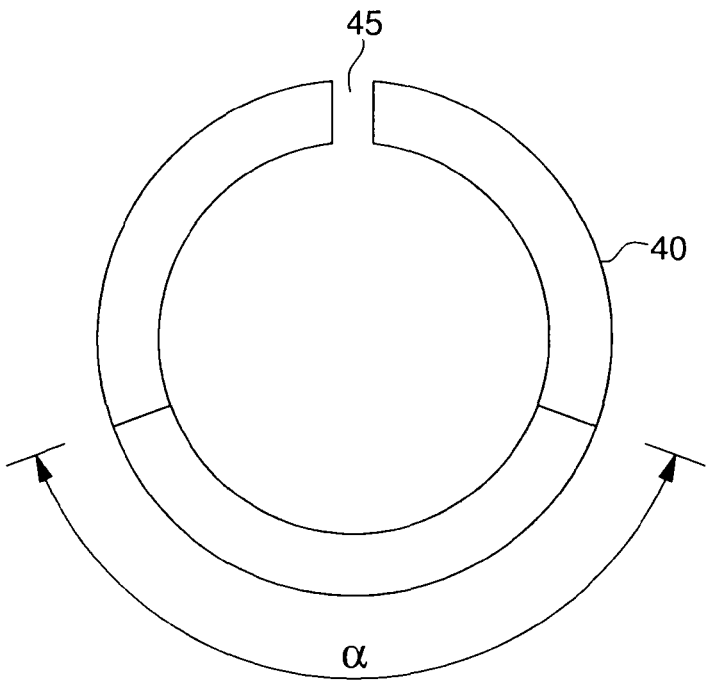

Reference will now be made to FIG. 5 which shows a transverse cross-section of the axial locking element 31. According to the invention, the first and second tubes 40 and 41 are provided with an annular end via which they are secured over an angular portion $\alpha$ of less than 180°, extending substantially opposite longitudinal slit 45. Said tubes 40, 41 are, for example, spot welded on angular portion $\alpha$. Because of this feature, tubes 40 and 41 form a single axial locking element 31 for pin 30 instead of two distinct elements formed by the first and second tubes 40, 41. It will be noted that the angular portion $\alpha$ via which they are secured is less than 180° and is opposite longitudinal slit 45 in order to preserve the radial elasticity of first slit tube 40. Indeed, this property is essential for holding pin 30 axially inside the aligned through holes 12, 22, 23 and for dismantling said pin in order, for example, to remove or add a link. Trials have demonstrated that beyond 180°, the radial elasticity of the first slit tube 40 is reduced, which may cause the weld between the first and second tubes 40, 41 to give way, and possibly decrease the elasticity of first tube 40. Advantageously, the angular portion $\alpha$ is greater than 140°, in order to hold the two tubes 40, 41 properly.

Assembly of the articulated bracelets according to the invention is made easier and quicker compared to assembly of a state of the art bracelet. An axial locking element 31 is inserted in a first through hole 12 of a first I-shaped link 10, then said first link 10 is engaged between the branches of a second H-shaped link 20. A pin is driven into axial locking element 31 through the alignment formed by the three holes 12, 22, 23. The two links 10 and 20 are consequently articulated to each other. Any confusion between a slit tube and non-slit tube is avoided, and the time taken for inserting the locking element is divided in half.

There has thus been described a bracelet with articulated links that is easy and quick to assemble. Of course, the bracelet according to the invention is not limited to the embodiment that has just been described and various simple alterations and variants can be envisaged by those skilled in the art without departing from the scope of the invention as defined by the annexed claims.

Figure 6:
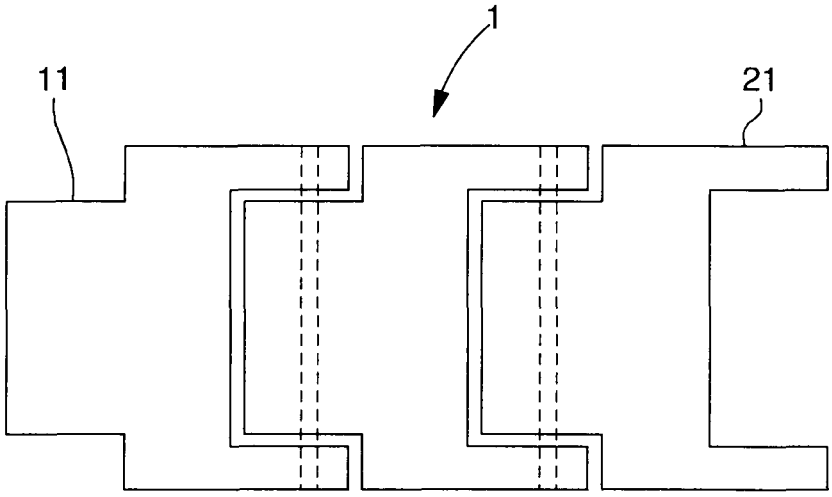
FIG. 6 illustrates a variant of an embodiment of the bracelet according to the invention.
Figure 7:
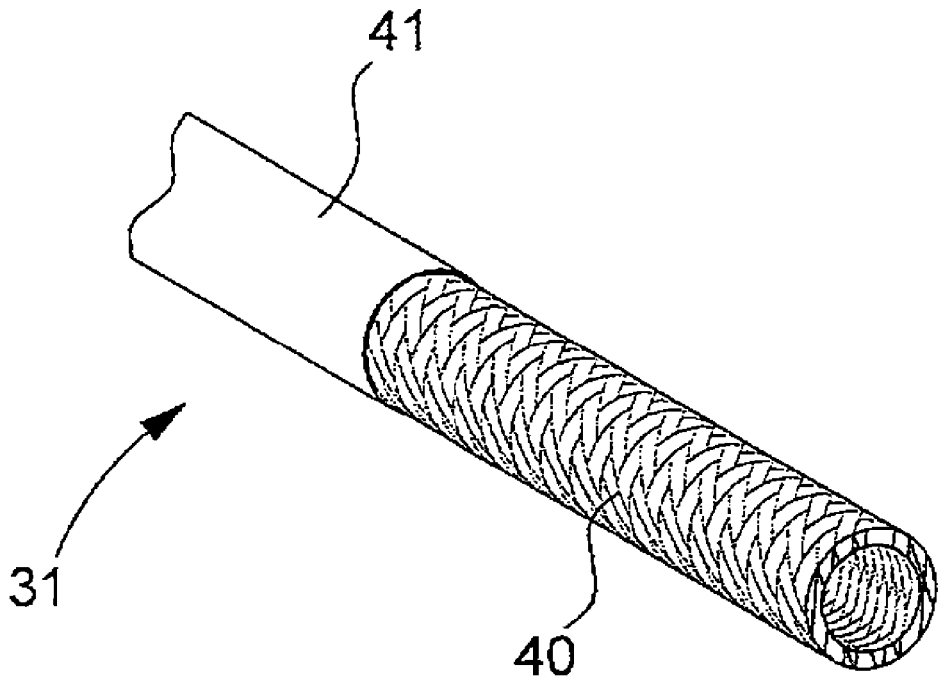
FIG. 7 shows a braided tube according to one or more examples of the invention.

It will be noted, first of all, that in the embodiment described above, the links are different and matched. Each includes two male hinge parts or two female hinge parts. In a variant, the links may be identical and each include a male hinge part and a female hinge part without altering the invention. A bracelet of this type is shown in FIG. 6.

It was also mentioned that axial locking elements 31 are formed of a first tube 40 provided with a longitudinal slit and a second non-slit tube 41. Of course, this embodiment may be extended to any axial locking member including a first radially elastic tube and a second tube that does not have this property. It will be noted, for example, that the first tube may be made of an elastic material such as rubber. It may also be formed of a metal or other braid that can extend radially. These types of tubes are well known to those skilled in the art. As for the slit tube, the weld between the two tubes must be carried out so as to preserve the radial elasticity of the first tube. This can be obtained, for example, by welding the two tubes at four points each separated by 90°. Each angular portion located between two weld spots preserves its radial elasticity, and consequently, the tube as a whole preserves its radial elastic property. Of course, welding can also be carried out, as previously, on an angular portion not exceeding 180°.

What is claimed is:

1. A bracelet with articulated links, comprising:

first links provided with a male hinge part pierced by a first through hole;

second links provided with a female hinge part pierced by second and third through holes, said first, second and third holes forming an alignment when a male hinge part is engaged in a female hinge part;

pins occupying said hole alignments; and axial locking elements for said pins formed of a first radially elastic tube and a second tube, axially locked in said first through holes, said pins being driven inside said first tubes, wherein said first and second tubes include an annular end via which said tubes are secured to each other so as to preserve the radial elasticity of said first tube and wherein said second tube is free of any means providing said second tube a radial elasticity.

2. The bracelet according to claim 1, wherein said first tube is provided with a longitudinal slit and wherein said first and second tubes are secured to each other over an angular portion $\alpha$ of less than 180°, extending substantially opposite said longitudinal slit.

3. A bracelet with links articulated like a hinge, comprising:

first links provided with a male hinge part pierced by a first through hole;

second links provided with a female hinge part pierced by second and third through holes, said first, second and third holes forming an alignment when a male hinge part is engaged in a female hinge part;

pins occupying said hole alignments; and axial locking elements for said pins formed of a first radially elastic tube and a second tube, axially locked in said first through holes, said pins being driven inside said first tubes, wherein said first and second tubes include an annular end via which said tubes are secured to each other so as to preserve the radial elasticity of said first tube and wherein said first tube is provided with a longitudinal slit and wherein said first and second tubes are secured to each other over an angular portion $\alpha$ of less than 180°, extending substantially opposite said longitudinal slit.

4. The bracelet according to claim 3, wherein said angular portion $\alpha$ is greater than 140°.

5. The bracelet according to claim 3, wherein the annular ends of said first and second tubes are spot welded on the angular portion $\alpha$.

6. The bracelet according to claim 4, wherein the annular ends of said first and second tubes are spot welded on the angular portion $\alpha$.

7. The bracelet according to claim 3, wherein said first tube is formed of an elastically deformable material.

8. The bracelet according to claim 3, wherein said first tube is formed of a braid.

9. The bracelet according to claim 3, wherein the internal diameter Di1 of said first tubes is slightly smaller than the external diameter D4 of said pins.

10. The bracelet according to claim 3, wherein the internal diameter Di1 of said first tubes is slightly smaller than the external diameter D4 of said pins and wherein said first tube is formed of an elastically deformable material.

11. The bracelet according to claim 3, wherein the internal diameter Di1 of said first tubes is slightly smaller than the external diameter D4 of said pins and wherein said first tube is formed of a braid.

12. The bracelet according to claim 3, wherein the diameter D1 of the first through holes is larger than the diameter D2 of the second and third through holes and in that the external diameters De1, De2 of said first and second tubes are larger than the diameter D2 of said second and third through holes and smaller than the diameter D1 of said first through holes.

13. The bracelet according to claim 3, wherein the diameter D1 of the first through holes is larger than the diameter D2 of the second and third through holes and wherein the external diameters De1, De2 of said first and second tubes are larger than the diameter D2 of said second and third through holes and smaller than the diameter D1 of said first through holes, and wherein said first tube is formed of an elastically deformable material.

14. The bracelet according to claim 3, wherein the diameter D1 of the first through holes is larger than the diameter D2 of the second and third through holes and wherein the external diameters De1, De2 of said first and second tubes are larger than the diameter D2 of said second and third through holes and smaller than the diameter D1 of said first through holes, and wherein said first tube is formed of a braid.

15. The bracelet according to claim 3, wherein said first and second links are different and matched.

16. The bracelet according to claim 3, wherein said first and second links are different and matched, and wherein said first tube is formed of an elastically deformable material.

17. The bracelet according to claim 3, wherein said first and second links are different and matched, and wherein said first tube is formed of a braid.

18. The bracelet according to claim 3, wherein said first and second links are different and matched, and wherein the internal diameter Di1 of said first tubes is slightly smaller than the external diameter D4 of said pins.

19. The bracelet according to claim 3, wherein said first and second links are different and matched, and wherein the diameter D1 of the first through holes is larger than the diameter D2 of the second and third through holes and wherein the external diameters De1, De2 of said first and second tubes are larger than the diameter D2 of said second and third through holes and smaller than the diameter D1 of said first through holes.

20. The bracelet according to claim 3, wherein said first and second links are different and matched and wherein said first links are I-shaped, said male hinge part being formed by a longitudinal half of said link, and said second links are H-shaped, said female hinge part being formed by the branches of the H.

21. The bracelet according to claim 3, wherein said first and second links are different and matched and wherein said first links are I-shaped, said male hinge part being formed by a longitudinal half of said link, and said second links are H-shaped, said female hinge part being formed by the branches of the H and wherein said first tube is formed of an elastically deformable material.

22. The bracelet according to claim 3, wherein said first and second links are different and matched and wherein said first links are I-shaped, said male hinge part being formed by a longitudinal half of said link, and said second links are H-shaped, said female hinge part being formed by the branches of the H and wherein said first and second links are different and matched, and wherein said first tube is formed of a braid.

23. The bracelet according to claim 3, wherein said first and second links are different and matched and wherein said first links are I-shaped, said male hinge part being formed by a longitudinal half of said link, and said second links are H-shaped, said female hinge part being formed by the branches of the H and wherein said first and second links are different and matched, and wherein the internal diameter Di1 of said first tubes is slightly smaller than the external diameter D4 of said pins.

24. The bracelet according to claim 3, wherein said first and second links are different and matched and wherein said first links are I-shaped, said male hinge part being formed by a longitudinal half of said link, and said second links are H-shaped, said female hinge part being formed by the branches of the H and wherein said first and second links are different and matched, and wherein the diameter D1 of the first through holes is larger than the diameter D2 of the second and third through holes and wherein the external diameters De1, De2 of said first and second tubes are larger than the diameter D2 of said second and third through holes and smaller than the diameter D1 of said first through holes.

25. The bracelet according to claim 3, wherein said first and second links are identical.

26. The bracelet according to claim 3, wherein said first and second links are identical and wherein said first tube is formed of an elastically deformable material.

27. The bracelet according to claim 3, wherein said first and second links are identical and wherein said first tube is formed of a braid.

28. The bracelet according to claim 3, wherein said first and second links are identical and wherein the internal diameter Di1 of said first tubes is slightly smaller than the external diameter D4 of said pins.

29. The bracelet according to claim 3, wherein said first and second links are identical and wherein the diameter D1 of the first through holes is larger than the diameter D2 of the second and third through holes and wherein the external diameters De1, De2 of said first and second tubes are larger than the diameter D2 of said second and third through holes and smaller than the diameter D1 of said first through holes.

* * * * *